US011713673B2

(12) United States Patent
Stewart

(10) Patent No.: US 11,713,673 B2
(45) Date of Patent: Aug. 1, 2023

(54) DEVICES, SYSTEMS, AND METHODS FOR DOWNHOLE EVENT DETECTION AND DEPTH DETERMINATION

(71) Applicant: GLOBALTECH CORPORATION PTY LTD, Forrestfield (AU)

(72) Inventor: Gordon Stewart, Forrestfield (AU)

(73) Assignee: Globaltech Corporation Pty Ltd, Forrestfield (AU)

( * ) Notice: Subject to any disclaimer, the term of this patent is extended or adjusted under 35 U.S.C. 154(b) by 66 days.

(21) Appl. No.: 17/056,019

(22) PCT Filed: May 17, 2019

(86) PCT No.: PCT/AU2019/050481
§ 371 (c)(1),
(2) Date: Nov. 17, 2020

(87) PCT Pub. No.: WO2019/218028
PCT Pub. Date: Nov. 21, 2019

(65) Prior Publication Data

US 2021/0215037 A1 Jul. 15, 2021

(30) Foreign Application Priority Data

May 18, 2018 (AU) ..... 2018901753

(51) Int. Cl.

| | |
|---|---|
| ***E21B 41/00*** | (2006.01) |
| ***E21B 47/14*** | (2006.01) |
| *E21B 17/08* | (2006.01) |
| *E21B 47/09* | (2012.01) |

(52) U.S. Cl.
CPC ..... *E21B 47/14* (2013.01); *E21B 41/00* (2013.01); *E21B 17/08* (2013.01); *E21B 47/09* (2013.01)

(58) Field of Classification Search
CPC ..... E21B 17/08; E21B 41/00; E21B 47/09; E21B 47/14; E21B 47/26
See application file for complete search history.

(56) References Cited

U.S. PATENT DOCUMENTS 8,505,632 B2 * 8/2013 Guerrero ..... E21B 34/06 166/373
10,444,392 B2 * 10/2019 Milne ..... G01V 1/226
2011/0290011 A1 12/2011 Dowla
(Continued)

*Primary Examiner* — Daniel P Stephenson
(74) *Attorney, Agent, or Firm* — Charles H Jew

(57) ABSTRACT

Detector device (10) mounts to a drilling rig (12) to sense sound or vibration signalled from downhole. The device (10) has a transmitter (10,20) to transmit data and/or an alert relating to sensed sound and/or vibration associated with deployment and/or positioning of a tool downhole. The device (10) recognises that one or more predetermined events or a pattern of events or one or more particular sound and/or vibration signatures occur(s). Downhole device (36) has a transmitter (38) transmitting a signal indicating a sensed pressure, position or motion change downhole. Communication between the downhole device and the device at the surface to determine depth or distance e.g. time of flight of a signal emitted by one device and the return signal from the other device or from the send and received times of the signal between the two devices based on their respective timers.

29 Claims, 4 Drawing Sheets

(56) References Cited

U.S. PATENT DOCUMENTS

| | | | | |
|---|---|---|---|---|
| 2014/0340990 | A1* | 11/2014 | Chen | E21B 47/06 367/83 |
| 2015/0226050 | A1 | 8/2015 | Bartel et al. | |
| 2015/0275649 | A1* | 10/2015 | Orban | G01N 23/00 235/375 |
| 2016/0003035 | A1 | 1/2016 | Logan et al. | |
| 2016/0298441 | A1 | 10/2016 | Orban | |
| 2016/0333673 | A1 | 11/2016 | Conocophillips | |
| 2017/0082766 | A1* | 3/2017 | Milne | G01D 5/14 |
| 2018/0135408 | A1 | 5/2018 | Cooley | |
| 2021/0215037 | A1* | 7/2021 | Stewart | E21B 41/00 |

* cited by examiner

DEVICES, SYSTEMS, AND METHODS FOR DOWNHOLE EVENT DETECTION AND DEPTH DETERMINATION

FIELD OF THE INVENTION

The present invention relates to a system, device and/or method for detecting a downhole event associated with a borehole of a drilling or exploration operation.

One or more forms of the present invention is applicable to detection of arrival or successful deployment of a device at a required location downhole.

One or more forms of the present invention may also, or instead, be applicable to determination of depth downhole.

BACKGROUND TO THE INVENTION

It is important to know when a device put into a borehole reaches its intended destination or has deployed downhole as expected.

This applies to upwardly inclined boreholes, downwardly inclined boreholes and horizontal boreholes, and can also apply to known drilling operations, such as diamond drilling, reverse circulation (RC) drilling, drill and blast holes.

The sort of downhole device that might need to be delivered to a required destination in a borehole includes a core orientation device, inner tube, backend assembly, survey instrument or probe.

Present practice is typically for a member of the drill rig team to 'listen' for the landing of the downhole device at the required destination downhole.

Such 'listening' usually involves the member of the team physically sensing the vibration and/or acoustic sound caused by the downhole device landing at a landing position downhole.

Such 'listening' is done by typically placing one end of an implement, such as a screwdriver or other solid metal rod, against the drill rod string and the other end of the implement against the ear/head of the listener to sense the vibration/acoustic caused by the device landing.

The listener also tries to gain a sense of whether or not the downhole device has correctly landed and possibly engaged within a landing zone down the hole.

The quality or type of vibration/acoustic for sensing such correct landing is something learned over time and as such is prone to human error and is not fool proof.

It can also be extremely useful to be able to readily determine depth within a borehole. For example, to know to what depth the borehole has reached, to what depth downhole devices might need to be deployed, at what depth a downhole device is expected to reach a landing point or take a reading/measurement/image etc.

Ready determination of depth, or being able to receive a signal from or at a downhole device, would be advantageous, particularly where equipment is already in place, such as a drillstring or wireline, preventing or restricting access into the borehole.

It is with the aforementioned issues in mind that one or more forms of the present invention has been realised.

It is desirable of the present invention to provide a system, device and/or method for achieving one or more of determining depth within a borehole, detecting one or more arrival of a device at a desired location in a borehole and detecting that the device has positioned as desired.

SUMMARY OF THE INVENTION

A first aspect of the present invention provides a device arranged and configured to detect at least one of sound and vibration associated with a downhole deployed tool arriving at a desired location downhole or deploying downhole.

Deployment downhole may include correct engagement with downhole equipment. For example, a coring instrument or probe latching into position or an overshot device engaging with a downhole locking coupling.

The device may include at least one attachment means or mounting means for removably attaching or mounting the device to a part of a drill rig at the surface. For example, the device may be attached or mounted to a drill string (such as a drill tube) of a drilling operation.

Alternatively or in addition, the device may be attached or mounted to a 'stick up' portion of a casing of a drilling operation.

The device may be provided downhole. The device may detect presence of, arrival of, position of or location of, or a combination of any two or more thereof, of a downhole device downhole.

The device may be incorporated with or communicate or be connected to a survey instrument.

The survey instrument may include a core orientation recording tool, a magnetic sensor, a resistivity sensor, an electromagnetic sensor, a radiation sensor, a pressure sensor, or a temperature sensor, or a combination of any two or more thereof.

The device may autonomously or automatically transmits a signal to be received at the surface once the downhole tool is at or near a predetermined speed, position, location or state of operation.

It will be appreciated that one or more embodiments of the present invention may provide a method or system wherein a downhole tool is put downhole and passes into/through, lands at or approaches a desired position, such as landing at a landing ring, the downhole tool autonomously sends a signal indicating its position, location or presence, then sends data giving other information.

It will be appreciated that the downhole device need not be triggered from the surface. For example, it may arrive downhole and then send the data/information relating to parameters/physical conditions/environmental conditions measured/detected downhole.

Sending a signal to the surface may be activated, initiated or continued by a pressure change, jolt (deceleration or change of acceleration/deceleration 'jerk'), external/internal trigger, such as a landing ring trigger, or a timer e.g. providing a time delay until activation.

A further aspect of the present invention provides use of a detector device to detect at least one location and/or deployment characteristic of a downhole tool deployed in relation to a drilling or downhole survey operation, the use including detecting at least one sound and/or at least one vibration associated with location and/or deployment and/or engagement of the tool downhole.

A further aspect of the present invention provides a method for detecting aboveground a downhole event, including providing aboveground a device including at least one sound sensor and/or at least one vibration sensor arranged and configured to sense sound and/or a vibration originating downhole.

Preferably at least one indicator can be provided to give at least one indication, such as one or more of a device operating (e.g. is monitoring for sound and/or vibration), to indicate that detection of a downhole event of interest has been detected.

A transmitter may be provided in the device to transmit data and/or an alert relating to sensed sound and/or vibration associated with deployment and/or positioning of a tool downhole.

The device may provide an alert (such as a confirmation of successful landing/deployment of a tool downhole) to a remote receiver, such as a laptop, computer, mobile phone, tablet or other remote receiving device.

The device and/or method may include capability to determine a signature of the sound and/or vibration of landing.

For example, the device and or method may be used to recognise that one or more predetermined events occur or a pattern of events occurs or one or more particular sound and/or vibration signatures occur(s), or a combination of any two or more thereof.

The device may be pre-programmed with one or more sound and/or vibration signatures and may be used to compare at least one sensed sound or vibration signal with stored signatures to determine whether correct landing and/or positioning and/or engagement has occurred downhole.

A noise and/or vibration caused by landing and/or by engagement of one or more latches or deployment of one or more devices downhole can be detected by the device at the surface through audible (sound) and/or vibration or a combination thereof.

An expected pattern of noise and/or vibration, such as landing, followed by deployment/engagement of one or more latches, can be used by the device and/or method to determine that a downhole tool has deployed correctly and is in position as required.

An incorrect signature or pattern can be indicated by the device or transmitted by the device as a landing and/or deployment error, and the tool may be retrieved or landing/deployment reattempted.

The detector device at the surface may be voice/sound activated/initiated. For example, the detector device may be started, brought out of a sleep/standby mode or switched on by sound/voice activation.

Sound activation may include clapping, a whistle, sound of an impact on the device or the device hitting another object, hitting two such devices together etc.

Alternatively, or in addition, a start control may be provided, such as an on button or switch, to commence operation of the detector device. One or more forms of the present invention may include motion sensing, such as shaking or turning upside down, to initiate/start the device.

The detector device may be incorporated into equipment at the surface. The detector device may be external to equipment at the surface.

Equipment at the surface may include one or more of an instrumented top drive subsystem, an instrumented sub, a force-torque sub, a wireless sub, or other instrumented device within or attached to the drill string or drill string drive system for a drilling or exploration operation.

The detector device may communicate with (such as wirelessly) one or more of the equipment at the surface.

The detector device may include a transmitter or may be connected to or in communication with a receiver/transmitter by wire or wirelessly.

One or more forms of the present invention may include sending at least one signal from a said downhole device when landed or proximate to landing.

For example, the at least one signal may be triggered and preferably sent by a transmitter device associated with the downhole device by the action of landing, passing or arriving proximate to or traversing through a downhole component, such as the landing collar or ring.

Triggering of the signal may be related to sensing of a parameter by a proximity sensor, Hall effect sensor, magnetic sensor (such as an induction or eddy current sensor), capacitance sensor, inductance sensor, an encoder (such as a rotary encoder), solenoid, an optical sensor, pressure sensor or any other position or physical parameter sensor.

The at least one signal sent from downhole can be transmitted through material of a drill string, inner tube and/or outer casing, such as through metal and/or carbon fibre of tubing extending downhole from the surface.

Two-way communication between the detector at the surface 'listening' for the landing and a landing detection sensor downhole may be provided.

For example, a signal may be communicated from the surface to the device downhole, or a signal may be communicated from the device downhole to the surface, or both directions of communication may be employed.

A signal sent downhole to the downhole device could be used to trigger operation of the device downhole and/or could be used to cease operation of the device downhole and/or could be used to cause the device downhole to switch operational modes, such as changing a detection range and/or resolution, changing a detection parameter (from e.g. pressure to temperature, from sound to vibration, or vice versa).

The at least one signal sent from the downhole device may include a signature signal.

The signature signal may be sent from the downhole device when landed, preferably triggered by the action of traversing through or impacting at the landing collar or ring or by one or more of the aforementioned hall effect or proximity sensor or any other position sensor.

Time of flight of the at least one signal sent from the downhole device to the surface, preferably received by the detector device or an instrumented drill-sub at the surface, may be used to determine at least a depth within the borehole.

The downhole tool may include at least one gyroscope, magnetometer, accelerometer and/or radiation sensor.

The downhole tool may detect and/or log radiation values and/or type of radiation detected and/or presence/absence of radiation and/or a radiation signature at a location or as location changes.

The downhole tool may detect and/or log electromagnetic signals, fluorescence, x-rays, magnetism, resistivity, induction, gamma radiation, density of liquid or rock, acoustic signals, gravimetric values and/or temperature.

The downhole tool may conduct borehole imaging (such as using one or more cameras) or may receive image data from one or more cameras or other imaging devices downhole.

The downhole tool may conduct geo-magnetic surveying or receive data form a geo-magnetic survey device.

Logging can include storing the detected radiation values/signature/type/data/changes into a memory.

Downhole position/location and depth may be transmitted to the surface or sufficient data transmitted to the surface for a processor at the surface to determine downhole position/location and/or depth.

A further aspect of the present invention provides for use of a downhole device having a transmitter device to transmit at least one signal through material of a drill string, drill tubes, inner tube, a fluid in a tube of the drilling/exploration system and/or outer casing to be detected at the surface.

Another aspect of the present invention provides a method of confirming arrival or positioning downhole of a drilling operation or drilling survey operation related downhole device by detecting sound and/or vibration at or adjacent to the surface, the sound and/or vibration originating from arrival or positioning downhole of the downhole tool or (electronic) device.

A still further aspect of the present invention provides a method of confirming arrival or positioning of a downhole device downhole by sensing a change in pressure and/or velocity downhole, and sensing sound and/or vibration at the surface, the sound and/or vibration associated with arrival or positioning of a downhole device downhole.

Preferably, the downhole device includes one or more of a core orientation device, inner tube, backend assembly, a survey instrument or probe (such as a probe that logs downhole sensed parameters, characteristics, values or physical activity).

Preferably the downhole device transmits the at least one signal on arrival downhole at a landing or arrival position, or when proximate a particular position or device, such as passing a sensor or signal triggering device, which may include a magnet, a reflector, a pressure sensor, optical sensor, or mechanical trigger device.

The at least one signal sent from the downhole device to the surface can include a pulse, a number of pulses or signature signal.

Alternatively, signalling between the downhole device and the surface may be two-way.

For example, the downhole device may communicate to the surface and at least one device at the surface may communicate to the downhole device.

A signal from the surface may be used to initiate or start-up or commence operation of the downhole device. The downhole device may sense vibration and/or sound sent from the surface.

A signal from the surface may be relayed to the downhole device via at least one other device provided in a communication pathway between the device at the surface and the downhole device.

In addition or alternatively, the downhole device may communicate to the surface, such as, for example, to indicate that the downhole device is in a particular mode of operation, has sensed a certain parameter or value, has not landed or arrived correctly, has sensed a problem or correct operation of other equipment downhole (such as latches deploying correctly or not deploying correctly, or a core sample tube being full or a core sample not progressing into the tube correctly).

Preferably the signature signal is indicative of a particular event, such as a first signature signal on the downhole device passing a predetermined position, or another signature signal on landing, or a further signature signal when the downhole device has latched/locked into position. One or more of the signature signals may be sent as required.

Preferably, the at least one signal sent from downhole and/or at least one signal from the detector device at the surface, may be transmitted to or received by or received within the equipment at the surface, such as a wireless drill-sub.

Data relating to depth and/or position of the downhole device may be provided to a display for the driller/operator to see.

Preferably the downhole device includes at least one pressure sensor and/or at least one accelerometer to detect a respective pressure and/or change in velocity when the downhole device lands in position or is sufficiently slowed downhole or when passing or arriving at a downhole marker/position, such as a landing ring or collar.

A pressure spike or change may be sensed by the downhole device when the downhole device, such as a downhole drill-sub, an inner tube or backed assembly or probe, lands at the landing ring or collar or other position.

Data or at least one signal from the detector device relating to detection of sound or vibration of the downhole device arriving at or nearing a downhole position, and data or at least one signal from the downhole device, such as a pressure spike or change in velocity signal or a signature signal, may be utilised to confirm that the downhole device has landed properly or is at a desired position or has engaged/latched into position.

Correct landing/deployment and/or pattern can be indicated by the device as a visual signal, such as a steady green light, and/or by a notification sound.

Incorrect landing/deployment can be indicated visually, such as by a red light, and/or by a different notification sound.

When the device is awaiting a sound and/or vibration, such as during lowering of the tool downhole, the device may give a sound and/or visual indication, such as one or more flashing lights and/or intermittent sounds, such as a series of bleeps.

It will be appreciated that vibration can be detected by the one or more accelerometers in the device.

Sound can be detected by one or more microphones in the device.

A further aspect of the present invention provides for use of a downhole device and a device at the surface at a drill site or an exploration site, one of the downhole device and device at the surface sending a signal to be received at the other of the downhole device and the device at the surface, the downhole device or the device at the surface receiving the signal and subsequently communicating a further signal back to be subsequently received by the other of the downhole device or the device at the surface.

A still further aspect of the present invention provides a method of communicating between a downhole device and a device at the surface at a drill site or exploration site, one of the downhole device and device at the surface sending a signal to be received at the other of the downhole device and the device at the surface, the downhole device or the device at the surface receiving the signal and subsequently communicating a further signal back to be subsequently received by the other of the downhole device or the device at the surface.

Another aspect of the present invention provides a system for communicating between a downhole device when deployed downhole and a device at the surface at a drill or exploration site, one of the downhole device and device at the surface including transmission means to send a signal to be received at the other of the downhole device and the device at the surface, the downhole device or the device at the surface including receiving means for receiving the signal and subsequently communicating via transmission means a further signal back to be subsequently received by the receiving means of the other of the downhole device or the device at the surface.

It will be appreciated that the downhole device communicates a signal to or receives communication of a signal from, or both, whilst deployed downhole, which may be whilst travelling down or up hole or whilst static, such as in a landed or paused position downhole.

Preferably, the downhole device has a timer. Preferably, the device at the surface has a timer. The timer of either said device may be a counter, a clock or a real time clock.

The timer of each of the downhole device and the device at the surface may be synchronised so that they measure or count the same periods of time as one another. That is, a single count by one timer (such as 1 second) may be the same count (such as 1 second) by the other timer.

Only one of the downhole device and the device at the surface need have a timer.

The downhole device may have a timer and may send a said signal to the device at the surface. The device at the surface may receive said signal, and may return a further signal to the downhole device. The downhole device may determine the round trip time taken for the signal sent and the return signal to arrive at the downhole device. The downhole device may log the time taken for the round trip signal.

The downhole device may calculate the time taken for a said signal to make a one way trip up or down the hole.

The one way trip time may be calculated by subtracting a processing time at the device at the surface from the overall round trip time, and halving that remaining round trip time.

With knowledge of transmission/propagation speed of a said signal through whatever medium the signal is transmitted between the downhole device and the device at the surface, the distance between the device at the surface and the downhole device can be determined. Such distance can be equated to the depth of the downhole device in the hole.

Alternatively, the device at the surface may send a said signal to the downhole device. The downhole device may receive said signal, and may return a further signal to the device at the surface. The device at the surface may determine the round trip time taken for the signal sent and the return signal to arrive at the device at the surface. The device at the surface may log the time taken for the round trip signal.

The device at the surface may calculate the time taken for a said signal to make a one way trip down or up the hole. The one way trip time may be calculated by subtracting a processing time at the downhole device from the overall round trip time, and halving that remaining round trip time.

The processing time at the device at the surface or the downhole device may be the time taken to receive a said signal, process and transmit a further signal in return.

Both the downhole device and the device at the surface may include a respective timer.

One of the downhole device or the device at the surface may send a signal to be received at the other of the device at the surface or the downhole device, noting the time the signal was sent. The downhole device or the device at the surface receiving the sent signal may return a further signal and note the time of sending. With timers counting at the same rate (e.g. 'synchronised', which can be synchronised in real time or counting at the same rate from a known time (which may be arbitrary) for each timer).

Comparison of the time difference of the sent signal from each of the said timers can be used to determine distance between the respective downhole and surface devices and therefore the depth of the downhole device in the hole.

A said signal may be created by a force actuator, such as an electromagnetic device (e.g. a solenoid) or a piezo-electric device.

Preferably, the force actuator creates a vibration signal that travels through the medium/media between the downhole device and the device at the surface or vice-versa, or each said device has a force actuator which creates a respective signal. The force actuator may vibrate and/or may strike a component downhole.

The medium or media between the respective devices may be water, drilling mud, metal or fibreglass or carbon fibre (such as a casing or drill string), or a combination of two or more thereof.

The downhole device and/or the device at the surfaced may include a receiver, such as a vibration detector, shock sensor or microphone or similar, or a combination of two or more thereof, to detect vibration and/or sound.

DESCRIPTION OF PREFERRED EMBODIMENT(S)

Figure 1:
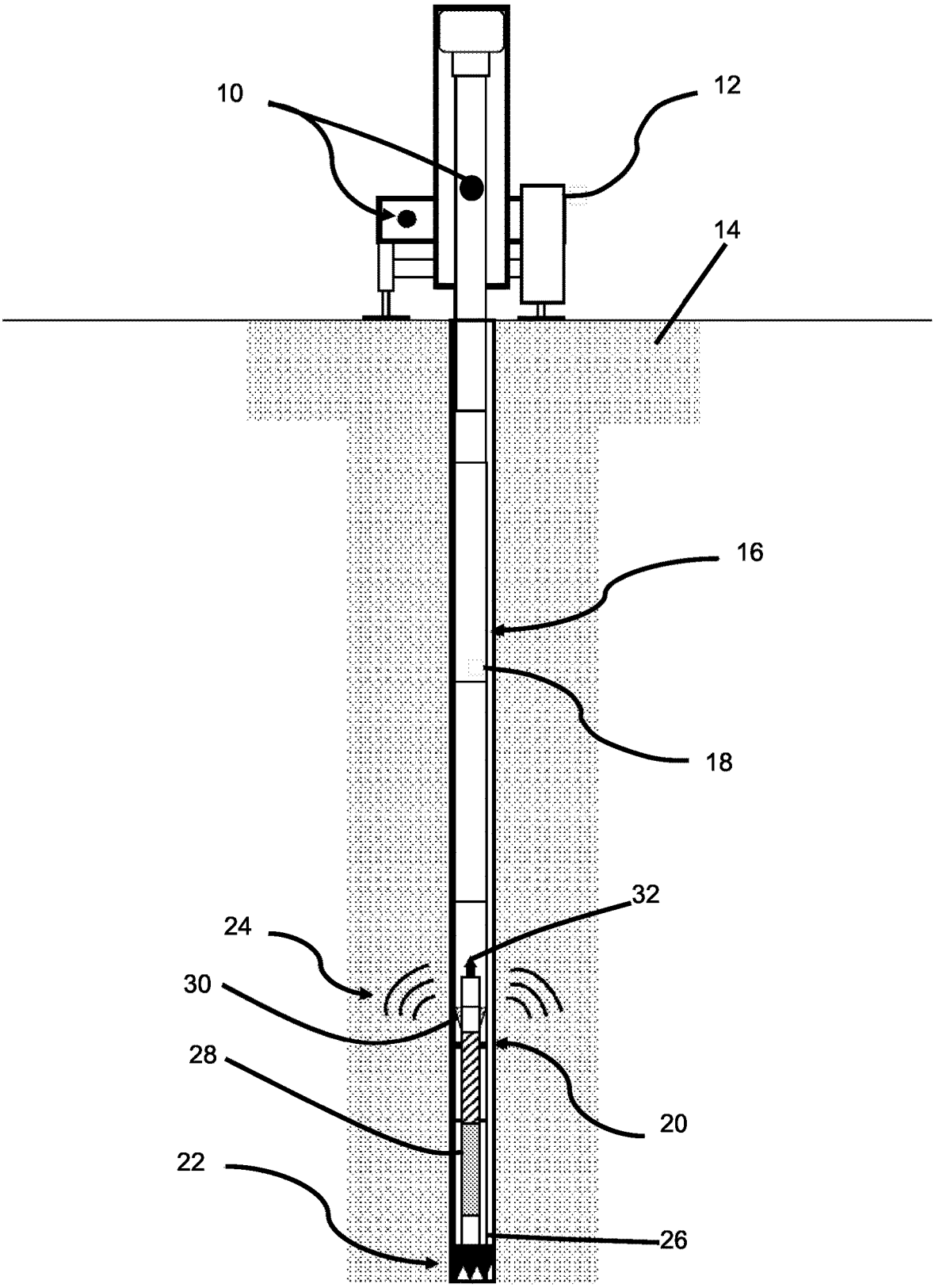
FIG. 1 shows a device deployed in situ at a drilling operation according to an embodiment of the present invention.

As shown by way of example in FIG. 1, a device 10 according to an embodiment of the present invention can be provided at a drilling site.

For example, the device 10 can be mounted onto part of a drilling rig 12, such as on a drilling tube or stick-up portion of the drilling operation. FIG. 1 shows two alternative positions for the device, one on the drill rods and one adjacent the drill rods. The drill rod mounted position is preferred, but it is to be appreciated that other positions can be acceptable.

The device 10 can be releasably attached via attachment means, such as by a housing 10.1 including one or more magnets 10.2 for attaching the device to a metal portion of the drilling rig.

Figure 2:
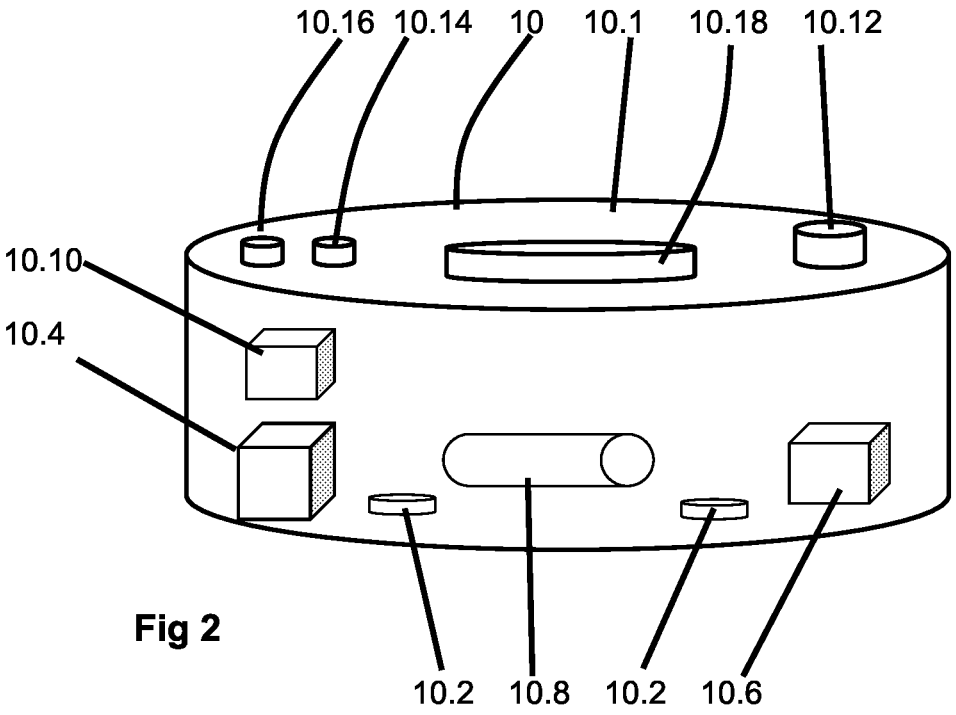
FIG. 2 shows a device according to an embodiment of the present invention.

The device, as shown by way of non-limiting example in FIG. 2, can include at least one sound sensor 10.4 or at least one vibration sensor 10.6, or a combination of any two or more thereof.

The at least one sound sensor may include at least one microphone.

The at least one vibration sensor may include at least one accelerometer, preferably multiple accelerometers, such as multi-axis accelerometers e.g. a tri-axial accelerometer.

The device 10 may include on-board power supply, such as a battery 10.8.

Alternatively or in addition, the device 10 may include on-board energy harvesting technology to power the device and/or to charge the battery.

For example, the device may include a piezo-electric device 10.10 responsive to vibration from drilling to generate electricity to power the device and/or to charge the battery or a capacitive charge storage device.

The device may include at least one on/off control 10.12 to initiate operation. The device may automatically switch off or go into a sleep mode after a period of time, or to conserve power e.g. when no sound or vibration, or no sound or vibration above a threshold level, is detected for a given period.

The device 10 can include at least one indicator, such as at least one indicator light 10.14, 10.16.

For example, an indicator light 10.14 can be provided to indicate that the device is operating (e.g. is monitoring for sound and/or vibration).

A further indicator light 10.16 can be provided to indicate that detection of a downhole event of interest has been detected.

The device 10 may include a transmitter 10.20 to transmit data and/or an alert relating to sensed sound and/or vibration associated with deployment and/or positioning of a tool downhole.

The device 10 may provide an alert (such as a confirmation of successful landing/deployment of a tool downhole) to a remote receiver, such as a laptop, computer, mobile phone, tablet or other remote receiving device.

FIG. 1 shows an embodiment of the present invention deployed in use in relation to a drill rig 12 for use in a drilling operation.

An inner tube 18 comprising several connected drill tubes extends into an outer casing 16 into the ground 14.

A drill bit 22 is provided at a distal end 26 of the inner tube.

A core barrel assembly or a probe 28 can be deployed, such as by wireline (not shown) into the borehole. The core barrel assembly or probe lands at and/or engages with a landing collar 20.

The impact of landing and/or a pattern of sound or vibration events, or a combination thereof, can be detected by the device 10.

In particular, the device 10 may include capability to determine a signature of the sound and/or vibration of landing.

For example, the device may include capability to recognise that one or more predetermined events occur or a pattern of events occurs or one or more particular sound and/or vibration signatures occur(s), or a combination of any two or more thereof.

The device may be pre-programmed with one or more sound and/or vibration signatures, and may compare at least one sensed sound or vibration signal with stored signatures to determine whether correct landing and/or positioning and/or engagement has occurred downhole.

As shown by way of example in FIG. 1, the assembly and/or probe 26 can include one or more latches 30 arranged and configured to engage with the inner tube.

The backend assembly may include at least one locking device 32, such as a locking coupling to engage with a retrieval device, such as an overshot coupling on a wireline.

Landing of the assembly and/or probe or other downhole tool (such as landing at a landing collar) and/or deployment of the latch(es) to engage the tool in position, can be detected by the device.

A noise and/or vibration caused by landing and/or by engagement of one or more latches or deployment of one or more devices downhole can be detected by the device at the surface through sonic (sound) and/or vibration or a combination thereof.

An expected pattern of noise and/or vibration, such as landing, followed by deployment/engagement of one or more latches, can be used to determine that a downhole tool has deployed correctly and is in position as required.

An incorrect signature or pattern can be indicated by the device or transmitted by the device as a landing and/or deployment error, and the tool may be retrieved or landing/deployment reattempted.

Correct landing/deployment and/or pattern can be indicated by the device as a visual signal, such as a steady green light, and/or by a notification sound.

Incorrect landing/deployment can be indicated visually, such as by a red light, and/or by a different notification sound.

When the device is awaiting a sound and/or vibration, such as during lowering of the tool downhole, the device may give a sound and/or visual indication, such as one or more flashing lights and/or intermittent sounds, such as a series of bleeps.

It will be appreciated that vibration can be detected by the one or more accelerometers in the device. Sound can be detected by one or more microphones in the device.

Figure 3:
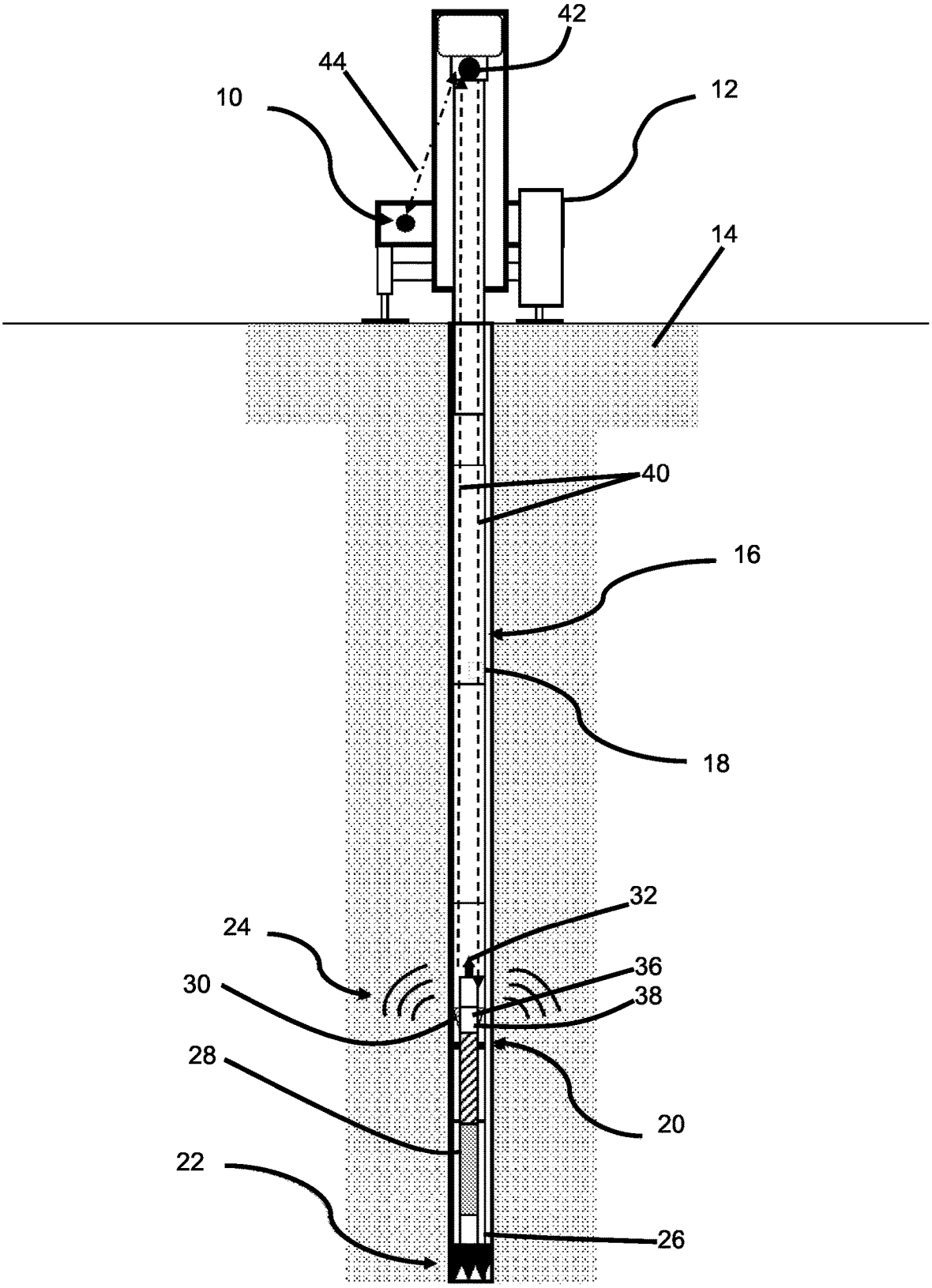
FIG. 3 shows an alternative embodiment of the present invention.

As shown by way of example in FIG. 3, a downhole device 36 may include a transmitter 38 to transmit at least one signal indicative of a sensed pressure and/or motion change downhole.

For example, the downhole device may detect a change in pressure and/or a change in velocity on landing or nearing landing downhole.

The at least one signal can be transmitted 40 through the material of the inner tube, drill string or outer casing.

The at least one signal transmitted from downhole can be received by the detector device 10 or other equipment, such as a drill sub 42 at the surface.

The detector device and the other equipment, such as the drill sub 42, may communicate 44.

For example, data/signal associated with sound and/or vibration detected by the detector device at the surface relating to the downhole device landing or nearing landing or latching into position downhole can be associated with, compared with or displayed together with data/signals obtained from the downhole device associated with pressure and/or change in velocity when the downhole device lands or is near landing or latches into position, to confirm as a double check that the downhole device has arrived or is near arriving in position.

Figure 4:
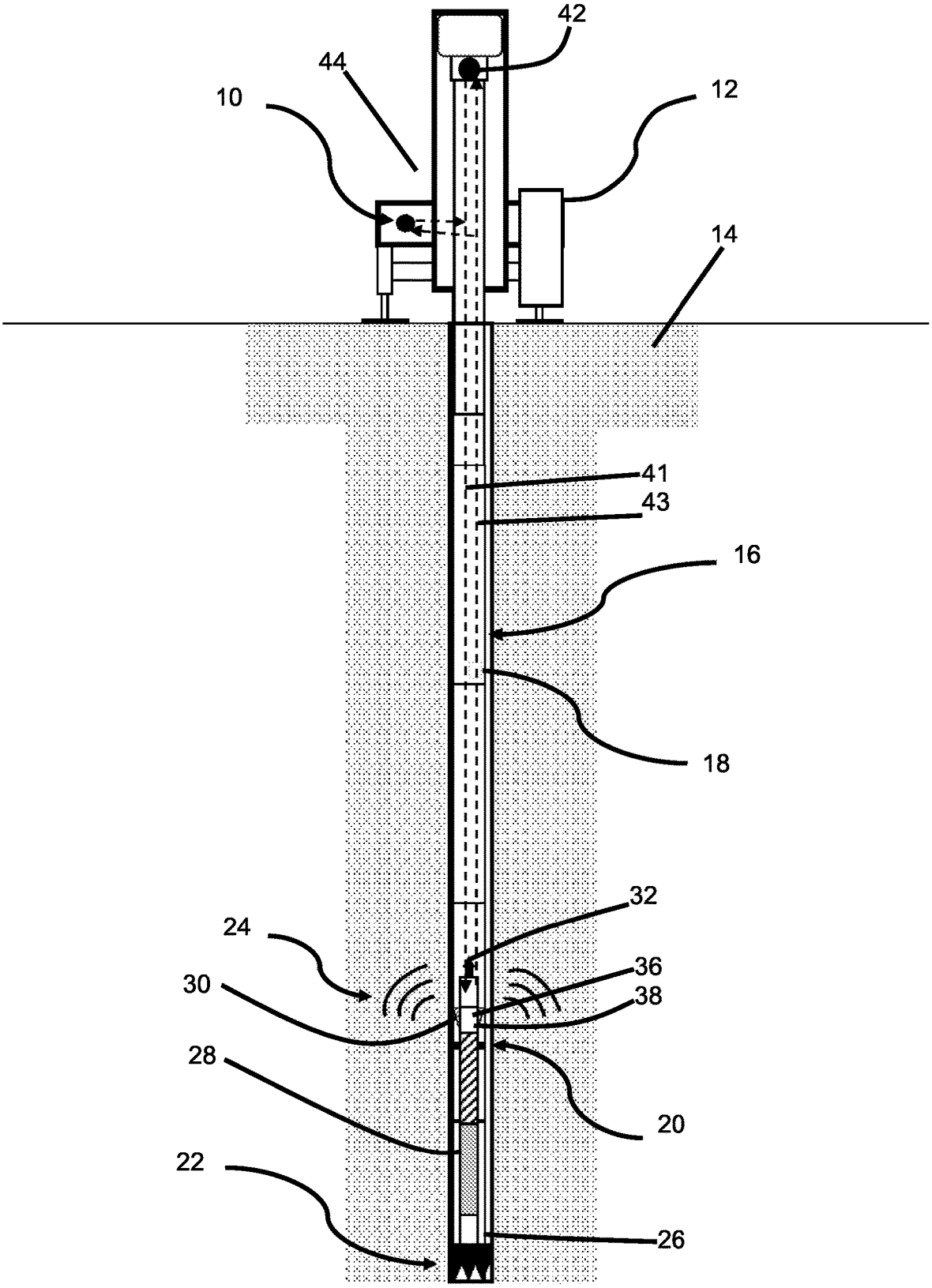
FIG. 4 shows at least one further embodiment of the present invention.

FIG. 4 shows at least one further embodiment of the present invention.

A device 11 at the surface may transmit a signal to or receive a signal from, or both, a downhole device 36. The downhole device 36 may transmit a signal to or receive a signal from the device 11 at the surface.

The device at the surface may be or may incorporate the detector device 10 or may communicate with the detector device 10.

In use, the downhole device may send a signal 43 to the device at the surface, for example, to indicate landing downhole, for use in determining depth, that a position has been reached, or to send data to the surface, or combinations of two or more thereof. The downhole device may include a timer, which timer may commence a count or record a time relating to the sending of the signal. The downhole device may send such a signal in response to a signal received from the device 11 at the surface.

The device 11 at the surface may send a signal 41 to the downhole device 36, for example, to seek confirmation of landing, for use in determining depth, that a position has been reached, or to send data to the surface, or combinations of two or more thereof.

The device at the surface may include a timer. Sending of the signal downhole may be associated with commencement of timing or noting of a time.

The device at the surface and/or the downhole device may include a respective force actuator or signal actuator. The force actuator or signal actuator may initiate the signal by creating a vibration and/or sound. For example, a solenoid or piezo-electric device may vibrate to create a vibration signal transmitted through at least one medium, such as metal of the drill tubes/casing or fluid within the drill tubes or casing.

One of the device at the surface or downhole device may use a time of flight of the signal emitted by that device and the return signal from the other of those devices to calculate, based on the time count of the timer of the signal originating device, the depth of the downhole device within the hole.

Alternatively, a calculation of the depth may be determined from the send and received times of the signal between the two devices based on their respective timers.

The invention claimed is:

1. A detector device arranged to be used in a surface drill rig and configured to detect at or near the surface at least one of sound and vibration associated with a downhole deployed tool arriving at a desired location downhole or deploying downhole based on a signature of the detected at least one of sound and vibration.

2. The detector device of claim 1, the device arranged and configured to detect at least one of location or deployment characteristic of a downhole tool deployed in relation to a drilling or downhole survey operation, the device including means for detecting at least one sound or at least one vibration associated with any one or more of: location, deployment, and engagement of the tool downhole.

3. The detector device of claim 1, including at least one attachment means or mounting means for removably attaching or mounting the device to a part of a drill rig, a drill string, a 'stick up' portion of a casing, or other installation, at the surface.

4. The detector device of claim 1, including a transmitter to transmit data and/or an alert relating to sensed sound and/or vibration associated with deployment and/or positioning of a tool downhole.

5. The detector device of claim 1, the detector device configured to determine a signature of the sound and/or vibration of landing.

6. The detector device of claim 1, the detector device being pre-programmed with one or more sound and/or vibration signatures to compare at least one sensed sound or vibration signal with stored said signatures to determine whether correct landing and/or positioning and/or engagement has occurred downhole.

7. The detector device of claim 1, wherein the detector device is incorporated into equipment at the surface, wherein the equipment at the surface includes one or more of an instrumented drillstring drive subsystem, an instrumented top drive, an instrumented chuck drive, an instrumented sub, a force-torque sub, a wireless sub, or other instrumented device within or attached to the drill string or drill string drive system for a drilling or exploration operation.

8. The detector device of claim 1, wherein the detector device is downhole and detects presence of, arrival of, position of or location of, or a combination of any two or more thereof, of a downhole device downhole.

9. The detector device of claim 8, wherein the detector device is incorporated with a survey instrument, a core orientation recording tool, a magnetic sensor, a resistivity sensor, an electromagnetic sensor, a radiation sensor, a pressure sensor, or a temperature sensor, or a combination of any two or more thereof.

10. The detector device of claim 8, wherein the detector device autonomously or automatically transmits a signal to be received at the surface once the downhole tool is at or near a predetermined speed, position, location or state of operation.

11. A system including a detector device according to claim 1 and a downhole device.

12. The system of claim 11, wherein the downhole device includes transmission means to transmit at least one signal when the downhole device has landed or proximate to landing.

13. The system of claim 12, wherein triggering sending of the at least one signal is related to sensing of a parameter by a proximity sensor, Hall effect sensor, magnetic sensor, capacitance sensor, inductance sensor, an encoder, solenoid, an optical sensor, pressure sensor or any other position or physical parameter sensor.

14. The system of claim 12, wherein the at least one signal sent by the downhole device from downhole is transmitted through material of a drill string, inner tube and/or outer casing.

15. The system of claim 11, including two-way communication between the detector at the surface and the downhole device when downhole wherein at least one signal sent downhole from the detector device to the downhole device is used to trigger operation of the downhole device and/or to cease operation of the downhole device and/or to cause the downhole device to switch operational modes.

16. A method of confirming at a surface drill rig arrival or positioning downhole of a drilling operation or drilling survey operation related downhole device by detecting at least one of sound and vibration at or adjacent to the surface, the sound and/or vibration originating from arrival or positioning downhole of the downhole device, confirming arrival or positioning downhole based on a signature of the detected at least one of sound and vibration.

17. The method of claim 16, including confirming arrival or positioning of the downhole device downhole by sensing a change in any one or more of pressure downhole, velocity downhole, and sensing at least one of sound and vibration at the surface, the at least one of sound and vibration associated with arrival or positioning of a downhole device downhole.

18. The method of claim 16, wherein the downhole device transmits the at least one signal on arrival downhole at a landing or arrival position, or when proximate a position or device, or when passing a sensor or signal triggering device.

19. The method of claim 16, wherein signalling between the downhole device and the surface is two-way, and at least one device at the surface communicates to the downhole device.

20. The method of claim 19, wherein a signal from the surface is used to initiate or start-up or commence operation of the downhole device.

21. The method of claim 20, wherein the downhole device senses vibration and/or sound sent from the surface.

22. The method of claim 19, wherein the at least one signal sent from downhole is transmitted to or received by or received within the device at the surface being part of or connected to an instrumented drill-sub.

23. The method of claim 16, wherein the downhole device communicates to the surface to indicate that the downhole device is in a particular mode of operation, or has sensed a certain parameter or value, or has not landed or arrived correctly, or has sensed a problem or correct operation of other equipment downhole.

24. The method of claim 16, wherein data relating to depth and/or position of the downhole device is provided to a display.

25. The method of claim 16, wherein the downhole device includes at least one pressure sensor and/or at least one accelerometer to detect a respective pressure and/or change in velocity when the downhole device lands in position or is sufficiently slowed downhole or when passing or arriving at a downhole marker/position.

26. The method of claim 16, wherein data or at least one signal from the detector device relating to detection of sound or vibration of the downhole device arriving at or nearing a downhole position, and data or at least one signal from the downhole device, such as a pressure spike or change in velocity signal or a signature signal, is utilised to confirm that the downhole device has landed properly or is at a desired position or has engaged/latched into position downhole.

27. The method of claim 16, including confirming arrival or positioning of a downhole device downhole by sensing a change in pressure and/or velocity downhole, and sensing sound and/or vibration at the surface, the sound and/or vibration associated with arrival or positioning of a downhole device downhole.

28. A method of confirming arrival or positioning downhole of a drilling operation or drilling survey operation related downhole device by detecting sound and/or vibration at or adjacent to the surface, the sound and/or vibration originating from arrival or positioning downhole of the downhole device, wherein transmission/propagation speed of a transmitted signal through whatever medium the signal is transmitted through between the downhole device and the detector device at the surface is used to determine distance between the detector device at the surface and the downhole device can be determined and equated to the depth of the downhole device in the hole.

29. A method of confirming arrival or positioning downhole of a drilling operation or drilling survey operation related downhole device by detecting sound and/or vibration at or adjacent to the surface, the sound and/or vibration originating from arrival or positioning downhole of the downhole device, wherein the detector device at the surface sends a said signal to the downhole device, the downhole device receives said signal and returns a further signal to the detector device at the surface, the detector device determines the round trip time taken for the signal sent and the return signal to arrive at the device at the surface.

* * * * *